US005727625A

United States Patent [19]

Youn et al.

[11] Patent Number: 5,727,625

[45] Date of Patent: Mar. 17, 1998

[54] HEAT EXCHANGER HAVING FINS WITH AIR CONDUCTING SLITS FORMED THEREIN

[75] Inventors: Back Youn, Suwon; Young-Saeng Kim, Incheon, both of Rep. of Korea

[73] Assignee: Samsung Electronics Co., Ltd., Suwon, Rep. of Korea

[21] Appl. No.: 760,716

[22] Filed: Dec. 5, 1996

[30] Foreign Application Priority Data

Dec. 5, 1995 [KR] Rep. of Korea ..... 95-46869

[51] Int. Cl.[6] ..... F28D 1/04; F28F 1/32

[52] U.S. Cl. ..... 165/151; 165/182; 165/DIG. 502

[58] Field of Search ..... 165/151, 152, 165/DIG. 508, DIG. 503

[56] References Cited

U.S. PATENT DOCUMENTS 4,691,768 9/1987 Obosu ..... 165/151
4,723,600 2/1988 Yokoyama et al. ..... 165/151
5,042,576 8/1991 Broadbent ..... 165/151

FOREIGN PATENT DOCUMENTS 60-20094 2/1985 Japan ..... 165/151
62-622391 11/1987 Japan ..... 165/151

*Primary Examiner*—Allen J. Flanigan
*Attorney, Agent, or Firm*—Burns, Doane, Swecker & Mathis, L.L.P.

[57] ABSTRACT

A heat exchanger includes a plurality of parallel spaced-apart fins and refrigerant-conducting tubes extending perpendicularly therethrough in a zigzagged arrangement. Slits are formed in each fin wherein there is a pair of slits directly in front of each pipe, a pair of slits at an upper front portion of the pipe, a pair of slits at a lower front portion of the pipe, a pair of slits at an upper central portion of the pipe, a pair of slits at a lower central portion of the pipe, a pair of slits at an upper rear portion of the pipe, a pair of slits at a lower rear portion of the pipe, and a pair of slits directly behind the pipe. The two slits of each pair extend from opposite sides, respectively, of the fin without any space formed between the slits, whereby the slits form contiguous air-conducting passages.

6 Claims, 3 Drawing Sheets

HEAT EXCHANGER HAVING FINS WITH AIR CONDUCTING SLITS FORMED THEREIN

BACKGROUND OF THE INVENTION

1. Field of the Invention

The present invention relates in general to a heat exchanger for air conditioner and more particularly, to a heat exchanger having slit type grilles in each of a plurality of heat exchanger fins.

2. Description of the Prior Art

With reference to FIG. 1, there is shown the construction of a conventional heat exchanger for an air conditioner. As shown in the above drawings, the conventional heat exchanger includes a plurality of regularly spaced flat fins 1. The fins 1 are vertically arranged such that they parallel each other.

A plurality of heat transfer pipes 2 are fitted into the fins 1 such that the pipes 2 are perpendicular to the fins 1. A air currents flow in the space defined between the fins 1 in the direction of the arrow in FIG. 1 and exchanges heat with fluid flowing in the heat transfer pipes 2.

A thermal fluid flowing about each of the flat fins 1 as shown in FIG. 2, has the characteristic that the thickness of the thermal boundary layer 3 on the both heat transfer surface of the fins 1 is gradually thickened in proportion to the square root of the distance from the air current inlet end of the fins 1. In this regard, the heat transfer rate of the fins 1 is remarkably reduced in proportion to the distance from the air current inlet end. Therefore, the above heat exchanger has a lower heat transfer efficiency.

When lower velocity air currents flow in the direction of the arrow of FIG. 3, the thermal fluid flowing about each heat transfer pipe 2 has the characteristic that the air currents separate from the outer surface of the pipe 2 at locations spaced apart from the stagnation point of the pipe 2 an angle of 70° (20). Therefore, a cavitation zone 4 is formed in the back of the pipe as shown in FIG. 3.

In the above cavitation zone 4, the heat transfer rate of the pipe 2 is remarkably reduced so that the heat transfer efficiency of the above heat exchanger become worse.

In order to overcome the above problems, Japanese U.M. Laid-Open publication No. Sho. 55-110995 proposes an improved heat exchanger for air conditioners. As shown in FIG. 4, the above Japanese heat exchanger includes a plurality of heat transfer pipes 2 which are fitted into regularly spaced flat fins 1 such that the pipes 2 are perpendicular to the fins 1. The above heat exchanger also includes a plurality of slit type grilles which are formed beside the pipes 2 on each of the fins 1. Each slit type grille is formed by vertically slitting a given portion of the fins 1 several times and alternately bending the remaining strips in opposite directions, thereby forming a plurality bent strips *5a*, *5b*, *5c*, *5d*, *5e*, and *5f* in the fins 1.

In other words, three strips *5a*, *5c* and *5e* are bent to one side of the fin 1, such that the strips *5a*, *5c* and *5e* are regularly spaced apart from each other. However, the other three strips *5b*, *5d* and *5f* placed between the above strips *5a*, *5c* and *5e* are bent to the other side of the fin 1.

The above heat exchanger having the plurality of slit type grilles on each of the flat fins 1 causes the heat exchanging fluid to become a turbulent flow due to the above grilles, thereby reducing the thickness of the thermal boundary layers formed on the fins 1.

As the above heat exchanger has thin thermal boundary layers formed on the fins 1 due to the slit type grilles, this heat exchanger somewhat improves the heat transfer efficiency in comparison with the conventional heat exchanger having the flat fins 1 with no slit type grilles.

When the partial heat transfer capacities of the heat exchanger are measured, the upstream strips *5a* and *5b* form the thin thermal boundary layers, thus to improve the heat transfer efficiency.

However, as the downstream strips *5c* to *5f* are included in the thermal boundary layers formed by the upstream strips *5a* and *5b*, the downstream strips *5c* to *5f* can not improve the heat transfer efficiency.

In addition, the cavitation zone is still formed in the back of each heat transfer pipe 2.

Furthermore, the air currents flowing in the space defined between the flat fins 1 are not mixed together but become laminar flows.

Therefore, the above Japanese heat exchanger is not expected to improve the heat transfer efficiency which will be improved when the air currents are mixed together.

SUMMARY OF THE INVENTION

It is, therefore, an object of the present invention to provide a heat exchanger for an air conditioner in which the above problem can be overcome and which mixes the turbulent flows on the flat fins together and improves the heat transfer efficiency and effectively reduces the cavitation zone formed in the back of each heat transfer pipe.

In order to accomplish the above object, a preferred embodiment of the present invention provides a heat exchanger for air conditioners comprising a plurality of regularly spaced flat fins parallel to each other for letting the air currents flow in the space between the fins, and a plurality of heat transfer pipes fitted into the fins perpendicular to the fins and zigzagged when viewing the pipes from one side of the fins, wherein the improvement comprises:

first a plurality of slit type grilles opening toward a flow direction of air currents so that the air currents flowing between surfaces of the plurality of flat fins and inner sides thereof can become turbulent and mixed at the front of the heat transfer pipes, second a plurality of slit type grilles opening toward the flow direction of air currents so that air currents diffused by the first slit type grilles can become turbulent and mixed again at upper and lower front portions of the heat transfer pipes, third a plurality of slit type grilles opening toward the flow direction of air currents so that air currents diffused by the second slit type grilles can become turbulent and mixed again at a lower and upper central portion of the heat transfer pipes, fourth a plurality of slit type grilles opening toward the flow direction of air currents so that air current diffused by the third slit type grilles can become turbulent and mixed again at a upper and lower rear portion of the heat transfer pipes, fifth a plurality of slit type grilles opening toward the flow direction of air currents so that air currents diffused by the fourth slit type grilles can become turbulent and mixed, thereby improving the heat exchanging efficiency and reducing the cavitation zone formed in the back of each heat transfer pipes.

BRIEF DESCRIPTION OF THE DRAWINGS

The above and other objects, features and other advantages of the present invention will more clearly understood from the following detailed description taken in conjunction with the accompanying drawings, in which.

DETAILED DESCRIPTION OF A PREFERRED EMBODIMENT OF THE INVENTION

Figure 1:
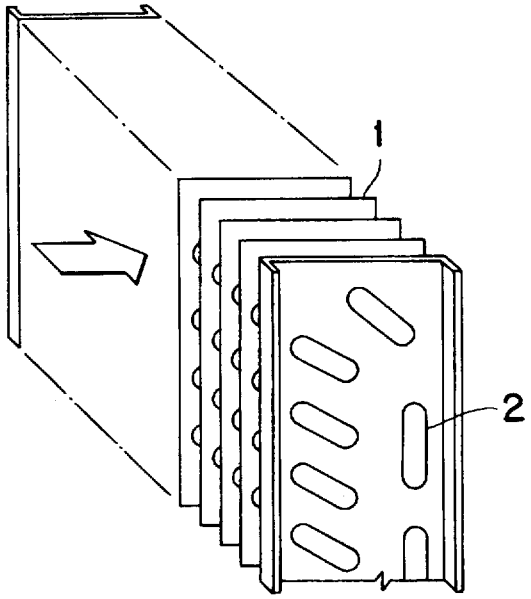
FIG. 1 (PRIOR ART)
FIG. 1 is a perspective view showing the construction of a conventional heat exchanger for air conditioner.
Figure 2:
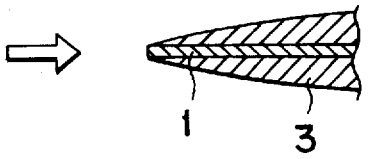
FIG. 2 (PRIOR ART)
FIG. 2 is an enlarged sectional view of a flat fin of the heat exchanger of FIG. 1, showing the characteristic of the thermal fluid flowing about the fin.
Figure 3:
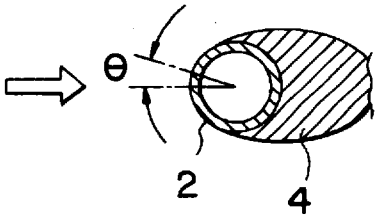
FIG. 3 (PRIOR ART)
FIG. 3 is an enlarged sectional view of a heat transfer pipe of the heat exchanger of FIG. 1, showing the characteristic of the thermal fluid flowing about the heat transfer pipe.
Figure 4:
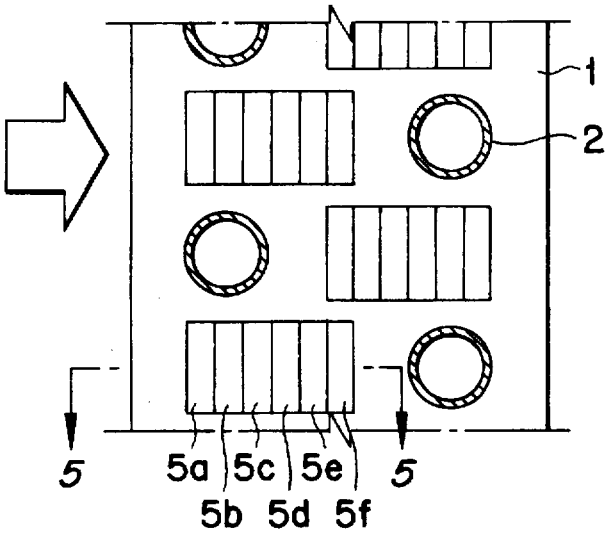
FIG. 4 (PRIOR ART)
FIG. 4 is a plan view of a flat fin having a plurality of slit type grilles in accordance with another embodiment of the prior art.
Figure 5:
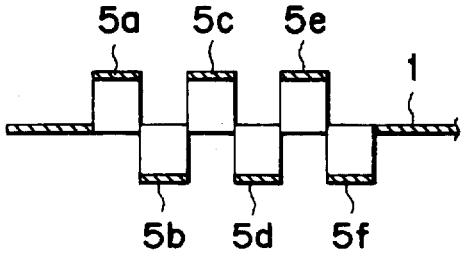
FIG. 5 (PRIOR ART)
FIG. 5 is a sectional view of one slit type grille of the flat fin taken along the section line 5—5 of FIG. 4.

The preferred embodiment of the present invention will now be described in detail with reference to the accompanying drawings.

Throughout the drawings, like reference numerals and symbols are used for designation of like or equivalent parts or portions, for simplicity of illustration and explanation.

Figure 6:
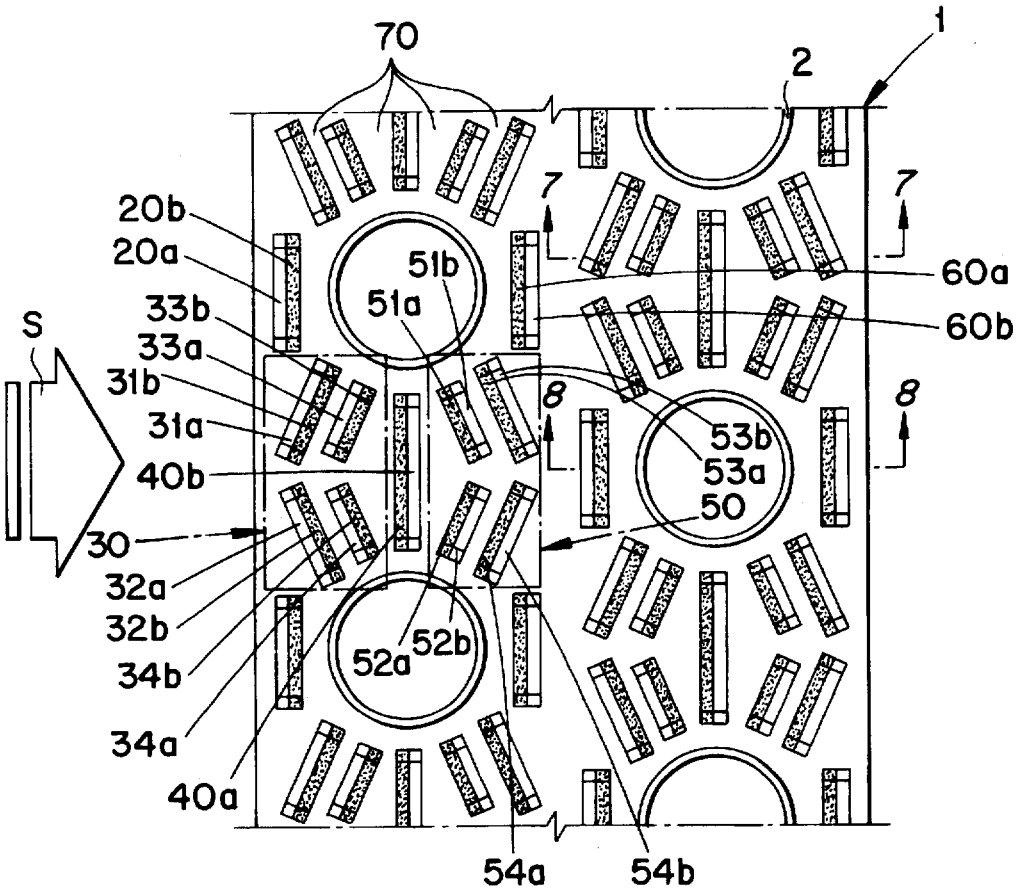
FIG. 6 is a plan view of a flat fin of the heat exchanger for air conditioner in accordance with a preferred embodiment of the present invention.

As shown in FIG. 6 the heat exchanger of this invention includes a plurality of flat fins 1 which are regularly spaced apart from each other and parallel to each other, thus letting air currents flow in the space defined between them, a plurality of heat transfer pipes 2 fitted into the fins 1 such that the pipes 2 are perpendicular to the fins 1 in a zigzagged pattern in order to let the air currents flow between the pipes. A first plurality of slit type grilles 20*a*, 20*b* is formed in each fin 1. These grilles are open in the flow direction of air currents so that the air currents flowing between surfaces of the plurality of flat fins 1 can become turbulent and mixed at the front of the heat transfer pipes 2. A second plurality of slit type grilles 30 is formed in each fin. Those grilles are open in the flow direction of air currents so that air currents diffused by the above first slit type grilles 20*a*, 20*b* can become turbulent and mixed again at upper and lower front portions of the heat transfer pipes 2. A third plurality of slit type grilles 40*a*, 40*b* are formed in each fin. Those grilles are open in the flow direction of air currents so that air currents diffused by the above second slit type grilles 30 can become turbulent and mixed again at lower and upper central portions of the heat transfer pipes 2. A fourth plurality of slit type grilles 50 is formed in each fin. Those grilles are open in the flow direction of air currents so that air currents diffused by the above third slit type grilles 40*a*, 40*b* can become turbulent and mixed again at upper and lower rear portions of the heat transfer pipes 2. A fifth plurality of slit type grilles 60*a*, 60*b* is formed in each fin. Those fins are open in the flow direction of air currents so that air currents diffused by the above fourth slit type grilles 50 can become turbulent and mixed again, thereby improving the heat exchange efficiency and reducing the cavitation zone formed in the back of each heat transfer pipes 2.

In this case, the first to fifth slit type grilles (20*a*) (20*b*), (30), (40*a*), (40*b*), (50), (60*a*) (60*b*), as shown in FIG. 6, are formed such that they are protrude in the shape of diamond on surfaces of the plurality of flat fins 1 and opposite sides thereof.

furthermore, the first to fifth slit type grilles (20*a*) (20*b*), (30), (40*a*), (40*b*), (50), (60*a*) (60*b*) are formed such that a predetermined bases or non-slit (flat) portions 70 are respectively positioned thereamong and alternately formed up and down between the surfaces and inner sides thereof.

furthermore, the first to fifth slit type grilles (20*a*)(20*b*), (30), (40*a*) (40*b*), (50), (60*a*), (60*b*) are radiantly disposed toward the center of the respective heat transfer pipes 2.

The first, the third, and the fifth slit type grilles (20*a*) (20*b*), (40*a*)(40*b*), (60*a*)(60*b*) lie in planes oriented perpendicular to the current direction S.

The second plurality of slit type grilles 30 include first and second slits (31*a*, 31*b*), (32*a*, 32*b*) formed with a predetermined slant and interval therebetween, so that air currents become turbulent and mixed when the same pass by the slits at the front of the plurality of heat transfer pipes 2, third and fourth slits (33*a*, 33*b*), (34*a*, 34*b*) formed with a predetermined slant and interval therebetween, so that the air currents become turbulent and mixed when the same pass by the slits at upper and lower front portions of the heat transfer pipes 2.

The fourth plurality of slit type grilles 50 include first and second slits (51*a*, 51*b*), (52*a*, 52*b*) formed with a predetermined slant and interval therebetween, so that air currents become turbulent and mixed when the same pass by the fin1 at the rear portion of the heat transfer pipes 2, third and fourth slits (53*a*, 53*b*), (54*a*, 54*b*) formed in the fin1 at the back of the first and second slits (51*a*, 51*b*), (52*a*, 52*b*) with a predetermined slant and interval therebetween, so that the air currents become turbulent and mixed when the same pass by the slits at the rear portion of heat transfer pipes 2.

The third plurality of grilles 40*a* 40*b* is arranged between the third and fourth slits (33*a*, 33*b*), (34*a*, 34*b*) of the second plurality of grilles 30 and the first and second slits (51*a*, 51*b*), (52*a*, 52*b*) of the fourth plurality of grilles 50.

Each of the first and second slits (31*a*, 31*b*), (32*a*, 32*b*), and the third and fourth slits (53*a*, 53*b*), (54*a*, 54*b*), has an area larger than those of the third and fourth slits (33*a*, 33*b*), (34*a*, 34*b*) and the first and second slits (51*a*, 51*b*), (52*a*, 52*b*).

The first and second slits (31*a*, 31*b*), (32*a*, 32*b*) have the same combined area as the third and fourth slits (53*a*, 53*b*), (54*a*, 54*b*).

The area of the third and fourth slits (33*a*, 33*b*), (34*a*, 34*b*) is the same as that of the first and second slits (51, 51*b*),(52*a*, 52*b*).

The first to fifth slit type grilles (20*a*) (20*b*), (30),(40*a*) (40*b*), (50), (60*a*) (60*b*) define respectively first and second air contiguous passages 80, 81 opening toward the flow direction of air currents so that the air currents flowing between surfaces of the plurality of flat fins 1 and inner sides thereof can become turbulent and mixed around the heat transfer pipes 2. The passages 80, 81 are "contiguous" in that they are not separated by any part of the fin.

The operational effect of the above heat exchanger will now be described hereinafter.

Figure 7:
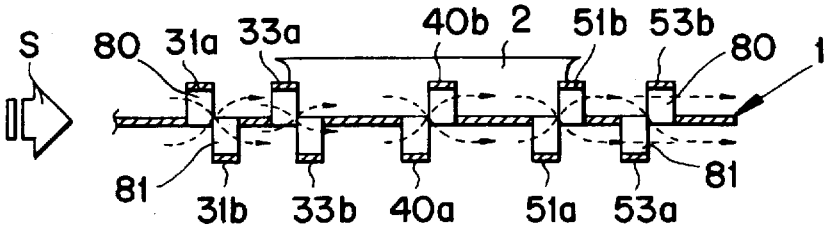
FIG. 7 is a sectional view of the flat fin taken along the section line 7—7 of FIG. 6.

When the air currents flow in the direction of the arrow S of FIG. 6 and FIG. 7, the air currents flow into the space between the flat fins 1 and pass by the first to fifth slit type grilles (20*a*) (20*b*), (30), (40*a*) (40*b*), (50), (60*a*) (60*b*), thus to become turbulent flow and to improve the heat transfer efficiency at both sides of the fins 1, and also to improve the heat exchanging efficiency by reducing the cavitation zone formed in the back of each heat transfer pipe.

Figure 8:
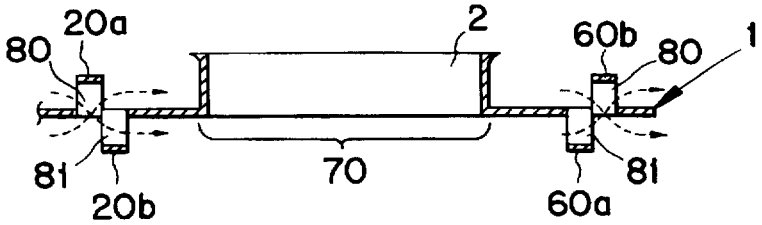
FIG. 8 is a sectional view taken along the section line 8—8 of FIG. 7

In other words, when the air currents, as shown in FIG. 8, pass through the first and second passages 80, 81 air of the slits 20*a*, 20*b*, the currents become turbulent and mixed at the front portion of the heat transfer pipes 2.

Then, the air currents pass through the first to fourth slits (31*a*, 31*b*), (32*a*, 32*b*), (33*a*, 33*b*), (34*a*, 34*b*), and rapidly become turbulent around the heat transfer pipes 2, and to thereby improve the heat transfer efficiency.

Furthermore, the passages 80, 81 of the third slit type grilles 40*a*, 40*b* are arranged for receiving air currents having passed through the second slit type grilles 30, whereupon the air currents rapidly become turbulent and mixed, and flows of heat from the heat transfer pipes is not interrupted to thereby expedite heat transfer from the central portion of the heat transfer pipes.

Furthermore, the passages 80, 81 of the fourth slit type grilles 50 are arranged for receiving air currents having passed through the third slit type grilles 40*a*, 40*b* whereupon the air currents rapidly become turbulent and mixed, and flows of heat from the heat transfer pipes is not interrupted to thereby expedite heat transfer at the rear portion of the heat transfer pipes.

In other words, because the first passages 81 and 80 are protrudingly formed at mutually opposite sides of the flat fins 1, so that the air currents passing through those passages across one another. Therefore thermal boundary layers are not formed in the direction of the air flow, to thereby improving the heat transfer efficiency of the heat exchanger.

Meanwhile, the passages 80, 81 provided at the fifth slit type grilles 60*a*, 60*b* are arranged for receiving air currents having passed through the fourth slit type grilles, whereupon the air currents rapidly become turbulent and mixed, thus reducing the cavitation zones formed in the back of the pipes and improving the heat transfer efficiency in the back of the pipes.

As is apparent from the foregoing, the heat exchanger for an air conditioner according to the present invention is provided with a plurality of the first and the fifth slit type grilles installed about the heat transfer pipes in lengthwise arrangement, and at the same time, in combination with a plurality of the second to fourth slit type grilles installed about the heat transfer pipes in an X-Shaped arrangement, so that air currents are mixed and become turbulent flows to thereby increase the heat transfer efficiency and to reduce the cavitation zone formed in the back of each heat transfer pipes. In addition, the heat exchanger for the air condition according to the present invention can prevent a flow of the heat from the heat transfer pipes from being interrupted to thereby expedite heat transfer and at the same time, to increase heat transfer among the plurality of heat exchange pipes.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claim is:

1. A heat exchanger for an air conditioner, comprising a plurality of flat fins disposed parallel to each other for conducting air currents in a direction of flow through spaces formed between adjacent ones of the fins, and a plurality of heat transfer pipes extending through the fins perpendicular to the fins in a zigzagged arrangement, each of the fins including:

a first plurality of slit-type grilles disposed in front of a respective pipe, the first plurality including a pair of slits opening on opposite sides of the fin, a second plurality of slit-type grilles disposed at upper and lower front portions of each pipe, the second plurality including at least one pair of slits disposed at an upper front portion of the pipe and extending from opposite sides of the fin, and at least one pair of slits disposed at a lower front portion of the pipe and extending from opposite sides of the fin;

a third plurality of slit type grilles disposed at upper and lower central portions of a respective pipe, the third plurality comprising a pair of slits disposed at an upper central portion of the pipe and extending from opposite sides of the fin, and a pair of slits disposed at a lower central portion of the pipe and extending from opposite sides of the fin;

fourth plurality of slit type grilles disposed at upper and lower rear portions of a respective pipe, the fourth plurality including at least one pair of slits disposed at an upper rear portion of the pipe and extending from opposite sides of the fin, and at least one pair of slits disposed at a lower rear portion of the pipe and extending from opposite sides of the fin; and a fifth plurality of slit-type grilles disposed behind a respective pipe, the fifth plurality including a pair of slits opening on opposite sides of the fin;

each pair of slits forming two air passages that are contiguous with one another.

2. The heat exchanger according to claim 1 wherein the slits of the second, third, and fourth grilles are oriented generally radiantly relative to the respective pipe.

3. The heat exchanger according to claim 1 wherein the slits of the second and fourth pluralities are oriented obliquely relative to the direction of flow.

4. The heat exchanger according to claim 3 wherein the slits of the first, third and fifth pluralities are oriented perpendicularly relative to the direction of flow.

5. The heat exchanger according to claim 1 wherein the second plurality comprises two pairs of slits disposed at the upper front portion and two pairs of slits disposed at the lower front portion.

6. The heat exchanger according to claim 5 wherein the fourth plurality includes two pairs of slits disposed at the upper rear portion; and two pairs of slits disposed at the lower rear portion.

* * * * *